United States Patent [19]

Hurni

[11] Patent Number: 4,589,343

[45] Date of Patent: May 20, 1986

[54] RAIL MAINTENANCE MACHINE THE CHASSIS OF WHICH IS EQUIPPED WITH A DEVICE FOR LIFTING AND SHIFTING A RAILWAY TRACK

[75] Inventor: Hans Hurni, Crissier, Switzerland

[73] Assignee: Matisa Materiel Industriel S.A., Crissier, Switzerland

[21] Appl. No.: 608,146

[22] Filed: May 8, 1984

[30] Foreign Application Priority Data

May 19, 1983 [CH] Switzerland ..... 2737/83

[51] Int. Cl.[4] ..... E01B 33/00; E01B 33/06

[52] U.S. Cl. ..... 104/7 B; 104/8

[58] Field of Search ..... 104/2, 5, 6, 7 R, 7 A, 104/7 B, 8, 9, 10, 12

[56] References Cited

U.S. PATENT DOCUMENTS

| | | | |
|---|---|---|---|
| 4,323,013 | 4/1982 | Theurer | 104/7 B |
| 4,342,263 | 8/1982 | Hurni | 104/7 B |
| 4,399,753 | 8/1983 | Theurer et al. | 104/7 B |
| 4,430,944 | 2/1984 | Theurer | 104/2 |

FOREIGN PATENT DOCUMENTS

| | | | |
|---|---|---|---|
| 1591311 | 6/1981 | United Kingdom | 104/7 R |
| 2077821 | 12/1981 | United Kingdom | 104/2 |

*Primary Examiner*—David A. Scherbel
*Assistant Examiner*—Dennis C. Rodgers
*Attorney, Agent, or Firm*—Anthony J. Casella; Gerald E. Hespos

[57] ABSTRACT

The machine is intended for the displacement of open track sections and switch gear. For this purpose, it is provided, for each line of rails, with a shifting roller (17), a hook (11) for the lifting of the switch gears and roller (12) for the lifting of the open sections, these tools being mounted on a tool holder (9, 10) moved by lifting (22) and shifting (23) jacks connected to the chassis (3) of the machine. The lifting hook (11) and the lifting roller (12) are mounted movable in rotation in a plane parallel to the track around a shaft (29) and are moved around said shaft by a jack (32) having two end-of-stroke positions corresponding to the operating position of one and the other of these two tools respectively. Other mountings permitting similar effects are described.

10 Claims, 15 Drawing Figures

RAIL MAINTENANCE MACHINE THE CHASSIS OF WHICH IS EQUIPPED WITH A DEVICE FOR LIFTING AND SHIFTING A RAILWAY TRACK

The object of the present invention is a rail maintenance machine the chassis of which is equipped with a device for lifting and shifting a railway track by means of displacement tools distributed on at least one tool holder attached to the rolling chassis via displacement controls with hydraulic jacks, in which these tools comprise, for each line of rails, at least one lifting roller and at least one shifting roller in order to lift and shift the track along clear sections as well as at least one lifting hook for replacing the lifting roller along switch gear, in which the shifting roller and the lifting tools are arranged one on the inside and the others on the outside of each line of rails respectively in order to collaborate in the grasping of the track, and in which there is provided a device for regulating the distance in height between the lifting hook and the shifting roller. This latter device permits adjusting of the positioning of the lifting hook to variations in its engagement with respect to the travel plane of the rail on which the shifting roller rests.

There are track maintenance machines known as "tamping, leveling and straightening machines" which are equipped with displacement devices of the aforementioned type and are used for the construction of the track as well as its maintenance.

With these machines the prescribed geometrical position of the track is obtained or corrected by simultaneous lifting and shifting by means of the displacement device, under the control of a measurement device which controls the displacement jacks of the tool holder or holders of the displacement tools while the ballast located below the ties is compacted by a tamping device in order to consolidate the position thus obtained. These operations are carried out step by step as the machine advances and in accordance with pre-established cycles as a function of criteria of maximum output and quality.

Along free or open sections of track it is the lifting rollers and shifting rollers which are used to lift and shift the track, the absence of lateral obstacles on the outer side of the two lines of rails making it possible to leave the flange and the periphery of the lifting rollers located on that side in permanent contact with the head of the rail.

Along switch gear, on the other hand, due to the presence of lateral obstacles on the outer side of the two lines of rail of the track followed by the machine, as, for instance, at the location of switches and crossings, it is the shifting rollers and the lifting hooks which are used to shift and raise the track, the lifting hooks being adapted to be moved towards the outside and adjusted in height according to the level of the possible gripping point with respect to the upper face of the head of the rails followed by the shifting rollers, which gripping point may, depending on the case, be the shoe of the rail or of an element of the switch gear or else the bottom of the said rail head or else a similar element of a competitive line of rail.

This possibility of replacing the lifting rollers by the lifting hooks upon passing from an open section to the switch gear and, vice versa, upon the emergence from said gear is advantageous since it makes it possible to assure the best quality of the work as well as the best output in both these cases with the same machine.

In fact, with a machine equipped with lifting rollers, such as a line tamper, the output is maximum on the open track since it is not necessary upon each step of advance to move said tool away in order then to replace it in contact with the head of the rail, this roller being in rolling contact with the said rail head. On the other hand, it is not possible to assure a quality displacement of switch gear due to the fact that whenever a lateral obstacle prevents the application of this roller the track cannot be lifted. With a machine equipped with lifting hooks, like a switch tamper, the output decreases substantially on the open track due to the fact that it is necessary to move said tool away for the duration of each advancing step in order to avoid its rubbing against the head of the rail. On the other hand, it is possible to assure a quality displacement of a switch gear due to the lateral and vertical mobility of the lifting hook as well as its relative thinness as compared with a lifting roller, which permit the maximum points of engagement all along the switch gear.

The change-over of the lifting rollers and hooks of known machines created to assure quality and output on the open track and those for switch gears is effected differently depending on the distribution of their displacement tools.

Thus, on a first known tamping-leveling-straightening machine, these tools are distributed on two separate tool holders, one comprising shifting rollers and lifting rollers for use on the open track and the other shifting rollers and lifting hooks for use on switch gear. In operation, the change-over is effected by placing one tool holder out of operation and the other in operation, and vice versa. It goes without saying that this change-over is effected here at the cost of duplication of most of the means necessary for the displacement of the track—shifting rollers, tool holders and hydraulic lifting and shifting controls—with, as initial consequence, a large size and a high cost price. Furthermore, as the two tool holders cannot be at the same place, they are at different distances apart in the direction of the track as compared with the tamping device; this has the result that the stresses suffered by the track differ depending on whether one or the other of the tool holders is used. This may cause problems in the case of corrections of strong lifting amplitude.

On a second known tamping-leveling-straightening machine, described in the French application published under No. 2,442,914, the said drawbacks are definitely attenuated by the fact that all of the displacement tools for the open track and for the switch gear are mounted on a single tool holder and by the fact that, on the latter, the shifting roller of each line of rails is mounted between the lifting hook and the lifting roller. In this way there is no longer a duplication of tools, tool holders or hydraulic lifting and shifting controls, which reduces the size and the cost price of the displacement device on this machine. The change-over of the lifting hooks and rollers is effected here directly by the placing in and out of operation one and the other on the tool holders. Furthermore, the bringing together of the lifting roller and the lifting hook on opposite sides of the shifting roller, has the result that the difference in stresses suffered by the track for a given value of correction at the level of the tamping tools, if it is not eliminated, is at least substantially reduced as compared with that of the first known machine. However, as the point of application of the lifting forces on the tool holders for each line of rails can only be fixed, at least one of the two lifting tools, the roller or the hook, is shifted with respect to this point by at least the distance which separates it from the shifting roller in the longitudinal direction of the track since this shifting roller is located between them. Therefore, in at least one of the two uses, on the open track or on switch gear, the lifting forces developed by the hydraulic controls create a tilting torque of the tool holders which must be compensated for both with regard to its effects on the rails of the track and with regard to the resistance and balance of the tool holder. For this reason there is provided in the case of this machine a variant in which the lifting hook is arranged between two lifting rollers which are spaced apart from each other, prefereably in the middle of them, in order to create advantageous conditions from the point of view of the transmission of the raising forces, the stress exerted on the rails as well as on the tool holders being thus substantially less during the course of the raising operation. However, this improvement can be obtained only by the addition of a supplementary lifting roller per line of rails as well as its own control, this to the detriment of the afore-mentioned advantages of reduction in size and in cost of the displacement device of this second machine.

In order to permit the adjustment of their points of engagement in the switch gear with respect to the travel surface of the head of the rails, the lifting hooks of these known tampers are mounted adjustably in height by translation with respect to the tool holder which supports them and on which the shifting rollers are also fastened.

On a third known tamper which is especially suitable for the displacement of switch gear, described in Swiss Pat. No. 633,054, the adjustment of the position in height of the lifting hooks with respect to the travel surface of the rails is effected by the moving together or apart of two superposed tool holders which are articulated to each other in the manner of tongs. In this structure, a first tool holder bears the shifting rollers and is actuated directly by the hydraulic shifting controls and a second tool holder supports the lifting hooks and is actuated directly by the hydraulic lifting controls. This particular arrangement permits the direct transmission of the shifting and lifting forces directly to the corresponding tools, without mechanical interference and without passing through controls for the adjustment of the position in height of the hooks with respect to the tool holders which support them.

The technical object of the invention is to reduce as much as possible the distance between the zones of action of the lifting roller and the lifting hook of each line of rails by proposing a simple, reliable and economical structure for the installation which permits the change-over of these two tools and which is applicable both to machines having a single tool holder and to machines having two superposed tool holders.

For this purpose, the machine in accordance with the invention is characterized by the fact that the lifting hook and the lifting roller of each line of rails are both mounted movable in height on a common support, and by the fact that this common support is mounted for movement on the tool holder which supports these two lifting tools at least in the transverse direction of the track.

In this way, the lifting hook and roller of each line of rails can be installed very close to each other in the longitudinal direction of the track since they are both mounted on the same support which is movable in the transverse direction of the track or, better yet, can act precisely at the same place, being installed movable in height by pivoting in a vertical or oblique plane on this common support in the manner of the tools of a turret. This installation, associated furthermore with the system for regulating the height of the lifting hook with respect to the plane of travel of the rails specific to one or the other of these machines having a single tool holder or two superposed tool holders confers upon these two lifting tools all the movements necessary for placing them in contact with the maximum engagement points and for their avoidance of obstacles and does this in a simple, reliable and economical manner which requires only a minimum number of mechanical moving members and hydraulic controls.

Various different arrangements resulting from this teaching, some applicable to machines with two superposed tool holders and others to machines having a single tool holder, are described below, each together with their specific effects and advantages.

In order to illustrate these various arrangements, the accompanying drawing shows, by way of example, two embodiments of the object of the invention as well as four variants of the first embodiment and two variants of the second embodiment.

Figure 1:
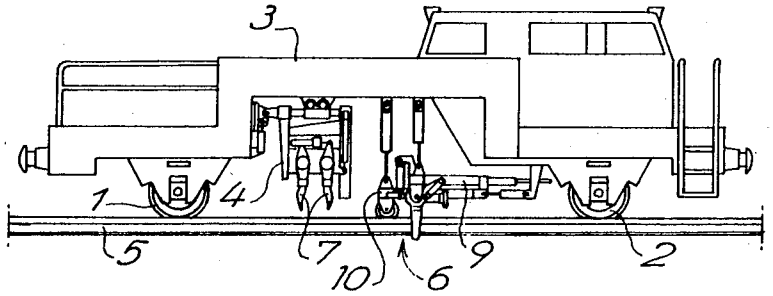
FIG. 1 is an overall view in elevation of the first embodiment.

The machine shown in FIG. 1 in its first embodiment is a rail tamping, leveling and straightening machine having, arranged between its axles 1 and 2 and suspended from its rolling chassis 3 a device 4 for tamping the ballast below the ties of the track 5 and a device 6 for displacing the track of the previously mentioned type with two superposed tool holders 9 and 10 articulated to each other, and which will be described in detail further below.

It is pointed out here that tamping machines of this type, which have been known for a long time, make it possible to lift and shift the track as they advance so as to bring it into or return it to the required position under the control of a device which measures its geometry and to consolidate the position thus obtained by tamping the ballast under the ties. In order to permit operation in regions occupied by switch gear, the tamping device 4 of these tampers has tools 7 which are adapted to be displaced transversely to the track so as to avoid the obstacles found by said switches when they are located at pumb with them in order to be able in this way to continue tamping the ties alongside them.

The two superposed tool holders 9 and 10 of the displacement device 6, shown in detail in FIGS. 2 to 8, have frameworks of T-shape parallel to the track 5.

The upper tool holder 9 supports, for each line of rails, a lifting hook 11 and a lifting roller 12 and its framework consists of a transverse beam 13 fastened at its center to a longitudinal pole 14, in its turn articulated for all azimuths in useful limits at its free end in a joint 15 borne by a bracket 16 fastened to the chassis 3 of the machine.

The lower tool holder 10 supports a shifting roller 17 for each line of rails, and its framework consists of a transverse beam 18 parallel to the beam 13 of the upper tool holder 9 and fastened at its center to a connecting arm 20 mounted for pivoting in a vertical plane perpendicular to the two said beams and by articulation on a pivot 21 which is located between the two ends of the pole 14 and suspended from said pole.

The upper tool holder 9 which bears the lifting hooks 11 and the lifting rollers 12 is moved vertically by a lifting control consisting of two substantially vertical hydraulic jacks 22 connecting the two ends of the beam 13 of said tool holder to the chassis 3 of the tamper, while the assembly of the two tool holders is displaced laterally by a shifting control consisting of two hydraulic jacks 23 connecting the beam 18 of the lower tool holder 10 supporting the lifting rolls 17 to the chassis 3 of the machine. These two shifting jacks 23 are arranged in known manner with concurrent line of action at a point located substantially at the level of the center of inertia of the track, and are included within substantially vertical plane.

The two beams 13 and 18 of these two tool holders 9 and 10 are connected at their ends by two jacks 24 for adjusting their vertical distance apart. These two jacks rest against offset brackets 25 and 26 fastened to these two beams. This system of connection constitutes here the means of adjusting the distance apart in height between the shifting roller 17 and the lifting hook 11 of each line of rails intended to permit this hook 11 to engage either under the head of the rail or below its shoe, as shown in FIGS. 1 to 4.

The translation of the end of the pole 14 within the joint 15, which translation is intended to permit avoidance of the ties for the grasping of the shoe of the rails or other elements of switch gear by the hooks 11 is controlled by a jack 27 which connects the bracket 16 to the pivot 21 borne by the said pole 14.

The two shifting rollers 17 rest on the rails of the track 5, which is followed by the machine during the operation; they have inside flanges intended both to guide the displacement device and to transmit to the rails the shifting forces generated by the shifting jacks 23.

The lifting hook 11 and the lifting roller 12 of each line of rails are mounted, both movable vertically, here by pivoting in a vertical plane parallel to the track, on a common support 28 which in its turn is mounted for movement below the beam 13 of the tool holder 9 by translation in the transverse direction of the track along a shaft 29 supported by two brackets 30 fastened to said beam.

The lifting hook 11 and the lifting roller 12 are here fastened rigidly to the common support 28 in two angular positions 90° apart from each other in their plane of rotation, and this common support, which is here in the form of a sleeve, is also mounted for rotation around the shaft 29.

Figure 4:
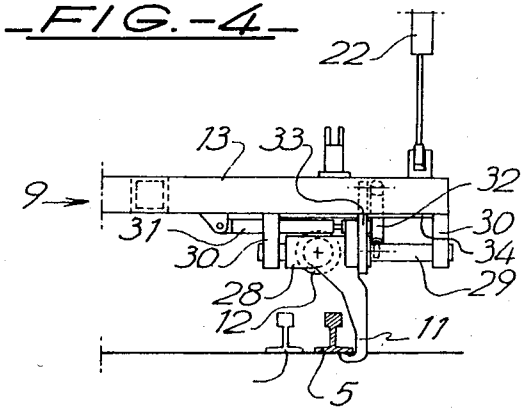
FIG. 4 is a view in elevation of a detail of FIG. 3.

The translation of each common support 28 along the shaft 29 is obtained by means of a double-acting hydraulic jack 31 resting against the beam 13, clearly visible in FIG. 4, and its rotation around this shaft is obtained by means of a double-acting hydraulic jack 32 resting against a side plate 33 which is mounted in relationship of translation with the common support 28 and is locked against rotation by retention between two rails 34 fastened below the beam 13. This particular mounting is shown in detail in FIGS. 7 and 8.

Figure 7:
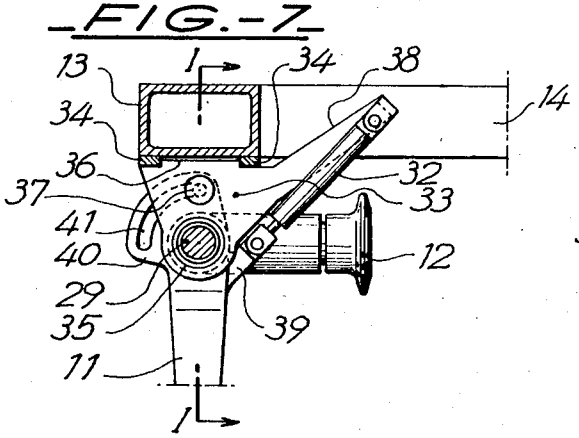
FIG. 7 is a view in partial elevation of a detail of FIG. 2.

In FIG. 7, the beam 13 and the shaft 29 are shown in cross section in order clearly to show the shape of the side plate 33. This plate 33, which is visible also in cross section in FIG. 8, has a bearing surface engaged concentrically to the shaft 29 on a cylindrical shoulder 35 of the common support 28 and has, opposite said bearing surface, an angular locking protrusion 36 engaged between the two rails 34. Between this bearing surface and this protrusion and in the axis of the jack 31 there is a cylindrical hole with conical inlet 37. This side plate 33 also has an arm 38 to the end of which there is articulated, resting against it, the aforementioned hydraulic jack 32 which furthermore is connected to a wrist pin 39 integral with the common support 28.

In order to bind this side plate 33 in translation to the common support 28 without, however, preventing the rotation of the latter around the shaft 29, said common support has a circular sector 40 provided with an opening 41 in the shape of a circular arc which passes in front of the hole 37 in the said plate and these two elements, the plate 33 and sector 40, are driven along and held with soft friction against each other by the end of the rod 42 of the jack 31 which, for this purpose, has a shoulder 43 resting against the sector 40 and a spherical stop ring 44 engaged in the conical inlet to the hole 37 in the plate.

The total stroke of the jack 32 is determined in such a manner that its two ends of stroke formed by the two stops of its chamber correspond to the lowered operating positions of either the lifting hook 11 or the lifting roller 12, while the other lifting tool is in raised position out of operation. In this embodiment this total stroke corresponds to an angular stroke of 90° of the common support 28 around the shaft 29 since these two lifting tools are fixed at an angular distance of 90° from each other on this common support. A different angular spacing, for instance greater or less than 90°, can be selected to the extent that the lifting roller 12, in raised position out of operation, will be sufficiently free above the rail.

Figure 6:
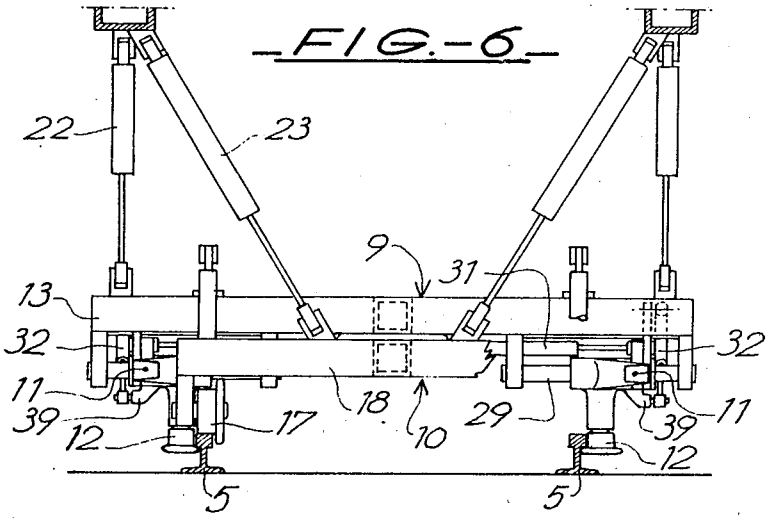
FIGS. 5 and 6 are a view in elevation and an end view respectively of this same displacement device shown in a second operating configuration.
Figure 5:
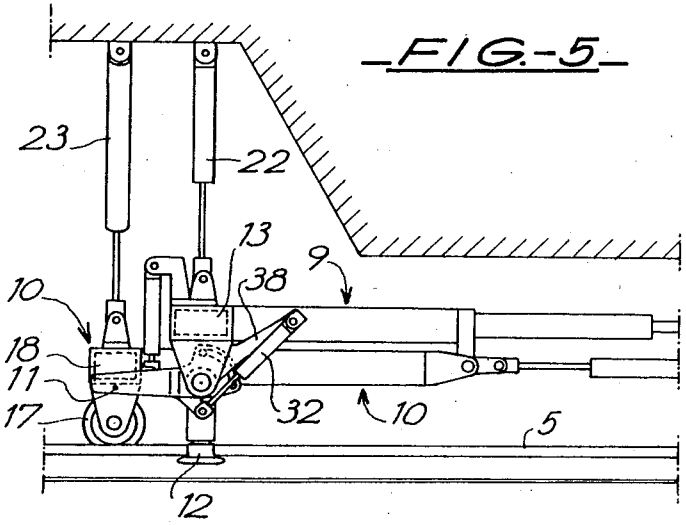
Figure 8:
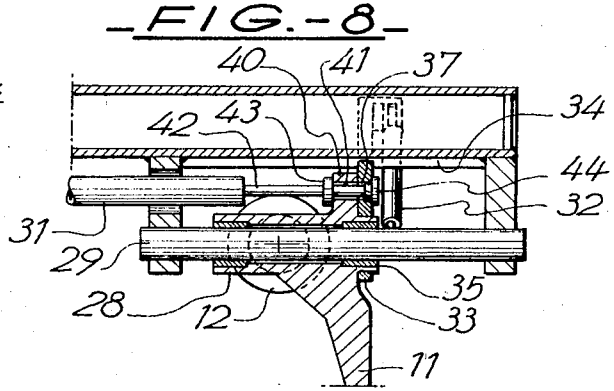
FIG. 8 is a section through this detail along the section line I—I of FIG. 7.

FIGS. 1 to 4 show the device for the displacement of the track in its configuration for working in switch gears by means of the lifting hooks 11 and shifting rollers 17, while FIGS. 5 and 6 show this same arrangement in its configuration for working on open track by means of the lifting rollers 12 and the same shifting rollers 17.

The switching between the lifting hook 11 and the lifting roller 12 of each line of rails is effected thus in very simple fashion by mere actuation of the jack 32 after having sufficiently moved the lifting tool in operation away from the rail by means of the jack 31 for the actuation of the common support 28, which operations may be controlled by push button from the driver's cab of the machine.

It is to be noted in FIGS. 5 and 6 that upon the lifting of the lifting hook 11 into position out of operation, the hook comes to the level of the transverse beam 18 of the tool holder 10 supporting the shifting rollers 17. For this reason, in order to permit this placing out of operation this lifting hook 11 is in a position shifted outwards in the transverse direction of the track with respect to the lifting roller 12 on the common support 28.

Developed in this manner, this change-over device for the lifting hooks and rollers affords the possibility of automatically placing these two types of lifting tools at exactly the same place in the longitudinal direction of the track with respect to the tool holder 9 which supports them and, therefore, with respect to the tamping tools 7 of the machine, which satisfies the desired purpose in an unexpected, simple and reliable manner. The simplicity and reliability reside in the fact that only a single support 28 is necessary to support these two tools and permit their change-over and that only a single jack 32 is necessary in order both to control this change-over and firmly maintain the tool placed in operation.

Other advantages result from the facts that a single shaft 29 fastened rigidly to the tool holder 9 is sufficient to assure the maintaining, translation and rotation of the common support 28, that the turning of this common support through an angle less than 180° permits simple control by jack, and that, finally, the two lifting tools 11 and 12 and the common support 28 form a monoblock piece between the points of transmission of the lifting forces generated by the jacks 22.

Changes may be made in this first embodiment, in particular with respect to the mounting of the two lifting tools 11 and 12 on the common support 28 and the mounting of the latter on the beam 13 of the tool holder 9.

Figure 9:
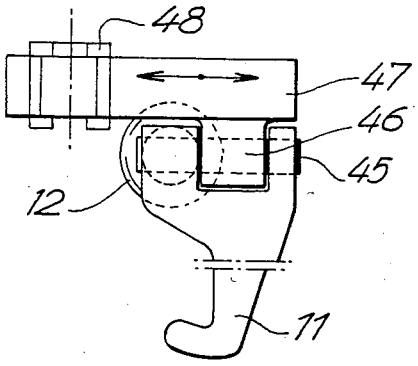
FIGS. 9, 10, 11 and 12 are four diagrammatic partial end views respectively of the four variants.

Thus, in a first variant, as shown diagrammatically in FIG. 9, the lifting hook 11 and the lifting roller 12 form a monoblock piece which is mounted for pivoting around a shaft 45 transverse to the track and borne by a bearing 46 which is integral with a common support 47 in the form of a slide block of rectangular section mounted, movable by translation in the transverse direction of the track within a slideway 48, shown in cross section, fastened below the transverse beam 13 of the tool holder 9, not shown in this figure.

In this first variant, the two lifting tools 11 and 12 are directed 90° apart from each other in their plane of rotation and are offset in the transverse direction of the track, as in the previous example and for the same reasons. Here also a single jack resting, for instance, on an arm integral with the bearing 46, is sufficient to assure the change-over of the two lifting tools by rotation around the shaft 45, and the common support 47 can be driven in translation by means of a jack buttressed directly between it and the beam 13, without requiring an intermediate part such as the side plate 33 of the preceding example.

This first variant has the same technical advantages as the preceding example; it constitutes a simplification with respect to the driving in translation of the common support 47 and the application of the jack controlling the rotation of the lifting tools around the shaft 45. The common support 47, however, in this case, only assures the translation of these two tools and a second element, the shaft 45, is necessary in order to permit their changeover by rotation.

Figure 10:
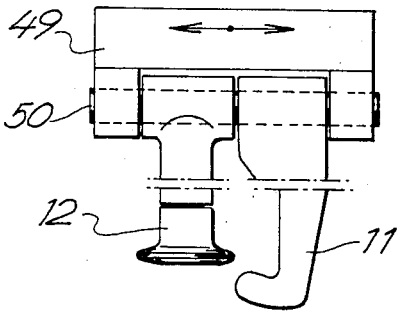

When independence of the movements for placing the two lifting tools 11 and 12 in and out of operation is desired, the second variant shown in FIG. 10 constitutes a solution.

In this second variant, the structure of the common support, indicated here as 49, is similar to that of the first variant, with the difference that the lifting hook 11 and the lifting roller 12 are articulated independently one behind the other on a shaft 50 borne by this common support 49. A single jack is also sufficient here to assure the translation of the common support 49, but two are necessary in order to assure the change-over of the two tools 11 and 12, one for each of these tools, also placed resting either each on an offset arm integral with the common support 49 or both on a common offset arm.

The pivoting movement of the two lifting tools 11 and 12 which makes it possible to assure their change-over can also take place in a plane transverse to the track, for instance when the size of their change-over path in the direction of the track is not desirable for reasons of lack of space or a desire to reduce this size to the minimum possible. The third variant, shown in FIG. 11, solves this problem.

In this third variant, the common support, here marked 51, is also in the form of a slide block of rectangular cross section, mounted for movement by translation in the transverse direction of the track in a slideway, as in the first two variants. The lifting hook 11 and the lifting roller 12 here form a monoblock part which is mounted for pivoting around a shaft 52, this time parallel to the track, supported by a bearing 53 which is integral with the common support 51. As in the two previous variants, a single jack is sufficient to assure the translation of the common support 51 and a single jack is also sufficient to assure the rotation of the two tools around the shaft 52.

Figure 12:
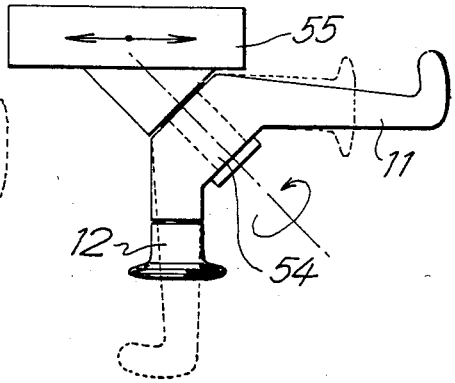

In a fourth variant, shown in FIG. 12, the two lifting tools 11 and 12 also form a monoblock movable part mounted for rotation this time on an oblique shaft 54, here inclined 45° in a vertical plane transverse to the track. This oblique shaft 54 is borne, overhung, by the common support indicated as 55 in this figure, which is similar to that of the three previous variants with respect to its guidance and drive by translation in the transverse direction of the track. It will be noted here that the change-over is effected by rotation of 180° of the monoblock part formed by the two tools 11 and 12 and that this rotation must be controlled by a motor with rotary drive shaft, the use of a jack being excluded.

Figure 13:
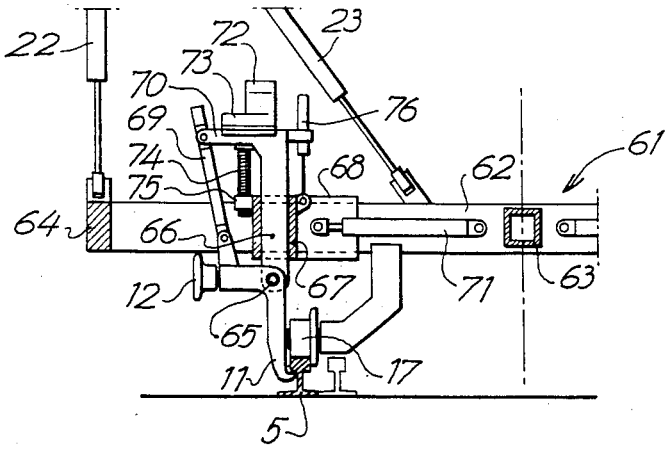
FIG. 13 is a diagrammatic partial end view of the second embodiment.

In its second embodiment, shown in FIG. 13, the device for the displacement of the machine in accordance with the invention consists of a single tool holder 61 on which the assembly of displacement tools is mounted, that is to say, for each line of rails 5, a shifting roller 17, a lifting hook 11, shown here in operating position, and lifting roller 12.

Figure 2:
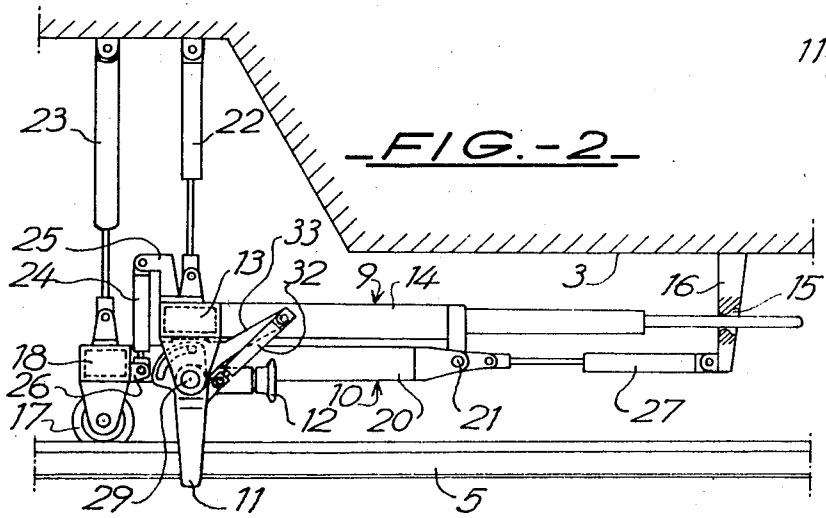

In this structure, the tool holder 61 is in this case also formed of a transverse beam 62 fastened at its center to a pole 63, shown here in cross section, arranged in the longitudinal direction of the track in the same manner as the pole 14 of the first embodiment shown in FIG. 2, in engagement in a joint 15 of a bracket 16 fastened to the chassis of the machine.

Figure 3:
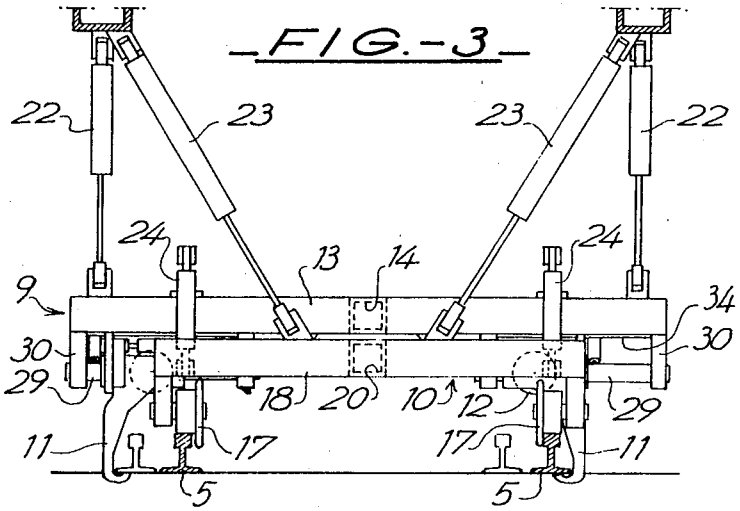
FIGS. 2 and 3 are a view in elevation and an end view respectively of its displacement device mounted in a first operating configuration.

The transverse beam 62, which is here formed of two parallel longitudinal members connected by end braces 64 and by the pole 63, is, on its part, connected to the chassis of the machine both by two lifting jacks 22 and by two shifting jacks 23 directed in the same manner as in FIG. 3. This beam 62 rests on each line of rails 5 via the shifting roller 17 installed in fixed position.

The lifting hook 11 and the lifting roller 12 here form a monoblock part which is mounted for rotation around a shaft 65 parallel to the longitudinal direction of the track and supported by a vertical slide block 66 engaging in a slideway 67 integral with a common support 68 mounted for movement in the transverse direction of the track by translation between and on the two lengthwise members of the transverse beam 62.

Figure 11:
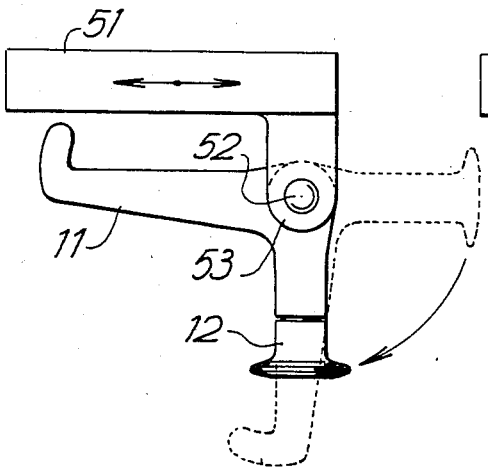

The pivoting of the two lifting tools 11 and 12 around the shaft 65 is controlled by a hydraulic jack 69 which is buttressed between a bracket 70 integral with the vertical slide block 66 and the arm of the lifting roller 12, this assembly being of a type similar to that which was described in conneciton with FIG. 11.

The translation of the common support 68 is controlled by a hydraulic jack 71 in the same way as in all the preceding examples.

The vertical slide block 66, in its turn, is driven in translation by a group consisting of the motor 72 and the reducer 73 and screw 74 fastened on the bracket 70 of this slide block, the screw 74 engaging in a nut 75 fastened to the slideway 67. This installation constitutes here the means of regulating the height of engagement of the lifting hook 11 with respect to the travel surface of the rail 5 on which the shifting roller 17 rests. This adjustment is obtained here by means of a regulating circuit comprising a linear position pick-up 76 whose body is fastened to the vertical slide block 66 and whose movable rod is fastened to the common support 68.

Figure 14:
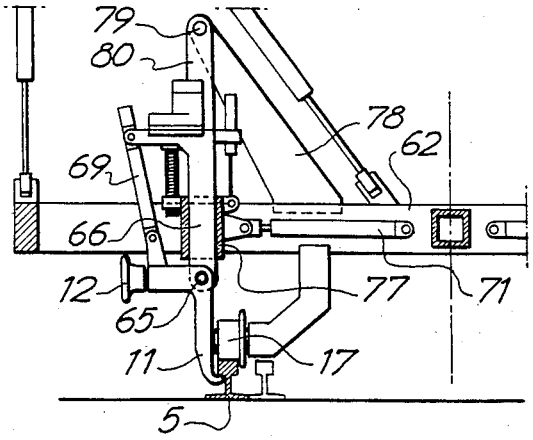
FIGS. 14 and 15 are two diagrammatic partial profile views of a first and a second variant of this second embodiment respectively.

In the first variant of this second embodiment, shown in FIG. 14, the change-over structure for the two lifting tools 11 and 12 and the structure of the regulation of the vertical position of the lifting hook 11 are identical to those of the second embodiment, which has just been described.

Here, however, the common support 77 is movable differently, namely by pivoting rather than translation. For this purpose, two brackets 78 are fastened to the two lengthwise members of the beam 62 and bear at their upper end, located substantially at plumb with the slide block 66, a shaft 79 parallel to the longitudinal direction of the track, and the common support 77 has two vertical side arms 80 articulated to said shaft 79. The transverse mobility of the common support 77 is controlled here also by a jack 71 arranged in the same manner as in the previous variant.

Figure 15:
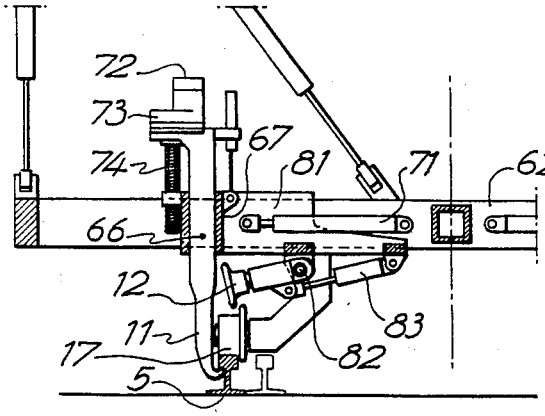

In the second variant of this second embodiment, shown in FIG. 15, the lifting hook 11 is directly mounted rigidly on the vertical slide block 66 moved by the motor reducer screw group 72, 73, 74 already described, so that its vertical mobility thus obtained by translation can serve both for the adjustment of its position in height as a function of the level of the possible engagements in the switch gear and the placing thereof out of operation of lifting above the level of the travel surface of the rail 5. The screw 74 is made sufficiently long for this last-mentioned purpose.

In this structure, the lifting roller 12 is mounted independently of the lifting hook 11 on the common support, here marked 81, by pivoting around a shaft 82 parallel to the longitudinal direction of the track and supported by this same common support in interior position with respect to the said hook. The pivoting of this roller is controlled by a hydraulic jack 83.

In this FIG. 15, the lifting roller 12 is placed in operation by pivoting towards the inside of the track after its pivot shaft has passed to the outside of the plumb of rail 5, by means of the jack 71 for actuating the common support 81. However, the plane of pivot of the roller 12 may be selected so as to be oriented in the longitudinal direction of the track also.

In the previous structures shown in FIGS. 13 and 14, the hook 11 and the lifting roller 12 can also be mounted for pivoting in a vertical plane parallel to the track, as in the first embodiment.

In fact, all combinations of movements inherent in the change-over of these two tools can be applied here also in this second embodiment.

Other variants, not shown, can be used without thereby going beyond the scope of the invention.

Thus for instance, in order to prevent the shifting forces applied to the tool holder 10 of the first embodiment from being transmitted to the lifting tools fastened on the tool holder 9 (FIGS. 4, 6 and 8), which could take place in the case of a very rigid design of the structure and of the connection of these two tool holders, the chambers of the double-acting jacks 31 controlling the transverse movement of the common supports 28 are connected to a supply circuit such as that described in Swiss Pat. No. 633,054 the effect of which is to permit free transverse displacement of the two common supports 28 as soon as they have been placed at a distance apart corresponding to the positioning of the two hooks or of the lifting rollers in engagement against the two lines of rails of the track.

Further in the first embodiment (FIGS. 7 and 8), the common support 28 can, instead of being mounted for rotation around the shaft 29, be simply movable by translation along said shaft, which permits the direct driving thereof in translation by the jack 31. In that case, the two lifting tools 11 and 12 form a monoblock part which is mounted for rotation concentrically to the shaft 29 on this common support 28 and the latter is integral with the arm 38 supporting the shaft 32 which drives these two tools in rotation and is locked against rotation either by keying onto the shaft 29 or by sliding of the arm 38 between two rails also.

Of course, the invention is applicable to machines having an individual tool holder per line of rails, which tool holder can, for instance, be suspended in pendulum manner so as to follow the rail.

Finally, the change-over of the two lift tools may be effected manually and the maintaining of them in operating and non-operating position can be assured by a mechanical interlock.

I claim:

1. A railway maintenance machine for a railway track having a plurality of lines of rails, said machine comprising a rolling chassis equipped with a device for lifting and shifting the rails of the railway track by means of displacement tools distributed on at least one tool holder connected to the rolling chassis via hydraulic jack displacement controls, in which these tools comprise for each line of rails of the railway track at least one lifting roller and at least one shifting roller in order to lift and shift the track along open sections as well as at least one lifting hook in order to replace the lifting roller along switch gear, in which the shifting roller and the lifting tools are arranged one on the inside and the others on the outside respectively of each line of rails in order to collaborate in the grasping of the track, and in which a device is provided for regulating the upward distance between the lifting hook and the shifting roller, wherein both the lifting hook and lifting roller of each line of rails are mounted movable in height on a common support and said common support is mounted movable on the tool holder which supports these two lifting tools at least in the transverse direction of the track, wherein said common support is in the form of a sleeve mounted movable by translation in the transverse direction of the track as well as movable by rotation in a vertical plane parallel to the longitudinal direction of the track by sliding and rotation along a shaft transverse to the track and fastened to the tool holder supporting the lifting hook and the lifting roller and wherein these two tools are fixed rigidly to said common support in two angularly spaced radial positions, their vertical mobility being obtained by rotation of the common support around the shaft.

2. A machine according to claim 1, wherein the common support comprises a side plate articulated concentrically to the shaft and immobolized in rotation in a slide integral with the tool holder, and wherein said plate is driven in translation by said common support and has a supporting arm for a jack for controlling the rotation of the said common support.

3. A railway track maintenance machine for a railway track having a plurality of lines of rails, said machine comprising a rolling chassis equipped with a device for lifting and shifting the rails of the railway track by means of displacement tools distributed on at least one tool holder connected to the rollling chassis via hydraulic jack displacement controls, in which these tools comprise for each line of rails of the railway track at least one lifting roller and at least one shifting roller in order to lift and shift the track along open sections as well as at least one lifting hook in order to replace the lifting roller along switch gear, in which the shifting roller and the lifting tools are arranged one on the inside and the others on the outside respectively of each line or rails in order to collaborate in the grasping of the track, and in which a device is provided for regulating the upward distance between the lifting hook and the shifting roller, wherein both the lifting hook and lifting roller of each line of rails are mounted movable in height on a common support and said common support is mounted movable on the tool holder which supports these two lifting tools at least in the transverse direction of the track, wherein the common support is in the form of a slide block mounted movable by translation in the transverse direction of the track in a slideway integral with the tool holder supporting the lifting hook and the lifting roller, and wherein these two tools are mounted movable in height by pivoting around a shaft supported by said common support.

4. A machine according to claim 3, wherein the shaft supported by the common support is directed in the transverse direction of the track, the lifting hook and the lifting roller being thus movable by rotation in a vertical plane parallel to the longitudinal direction of the track.

5. A machine according to claim 3, wherein the shaft supported by the common support is directed in the longitudinal direction of the track, the lifting hook and the lifting roller being thus movable by rotation in a vertical plane transverse to the track.

6. A machine according to claim 3, wherein the shaft supported by the common support is directed obliquely in a plane transverse to the track, the lifting hook and the lifting roller forming a monoblock piece mounted for movement by rotation in an oblique plane on said shaft and these two tools being directed radially on said monoblock piece at an angular distance from each other.

7. A machine according to claim 4, wherein the lifting hook and the lifting roller form a monoblock piece mounted for rotation on the shaft on which these two tools are directed radially with an angular distance apart of less than 180°, and wherein the rotation of these two tools around said shaft is controlled by a single jack.

8. A machine according to claim 4 wherein the lifting hook and the lifting roller are mounted for rotation independently of each other on the shaft and are each moved independently by a jack.

9. A machine according to claim 5, wherein the lifting hook and the lifting roller form a monoblock piece which is mounted for rotation on the shaft on which these two tools are directed radially at an angular distance apart less than 180°, and wherein the rotation of these tools around said shaft is controlled by a single jack.

10. A railway track maintenance machine for a railway track having a plurality of lines of rails, said machine comprising a rolling chassis equipped with a device for lifting and shifting the rails of the railway track by means of displacement tools distributed on at least one tool holder connected to the rolling chassis via hydraulic jack displacement controls, in which these tools comprise for each line of rails of the railway track at least one lifting roller and at least one shifting roller in order to lift and shift the track along open sections as well as at least one lifting hook in order to replace the lifting roller along switch gear, in which the shifting roller and the lifting tools are arranged one on the inside and the others on the outside respectively of each line of rails in order to collaborate in the grasping of the track, and in which a device is provided for regulating the upward distance between the lifting hook and the shifting roller, wherein both the lifting hook and lifting roller of each line of rails are mounted movable in height on a common support and said common support is mounted movable on the tool holder which supports these two lifting tools at least in the transverse direction of the track, wherein the common support is in the form of a slide block mounted for movement by translation in the transverse direction of the track in a slideway integral with the tool holder supporting the lifting tools, wherein the lifting hook is mounted movable by translation in the vertical direction in a slideway integral with said common support, and wherein the lifting roller is mounted movable by pivoting around a shaft fastened to the said common support, these two tools being installed independently of each other in the same plane transverse to the track and each moved by an independent drive member.

* * * * *